US006718146B2

(12) United States Patent
Nakamori

(10) Patent No.: US 6,718,146 B2
(45) Date of Patent: Apr. 6, 2004

(54) IMAGE FORMING APPARATUS AND IMAGE FORMING METHOD

(75) Inventor: Tomohiro Nakamori, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/126,683

(22) Filed: Apr. 22, 2002

(65) Prior Publication Data

US 2002/0164170 A1 Nov. 7, 2002

(30) Foreign Application Priority Data

Apr. 24, 2001 (JP) ..... 2001-125882

(51) Int. Cl.[7] ..... G03G 15/00; G03G 15/20

(52) U.S. Cl. ..... 399/22; 399/44; 399/68; 399/323

(58) Field of Search ..... 399/9, 16, 18, 399/21, 22, 44, 67, 68, 69, 322, 323, 398; 347/156

(56) References Cited

U.S. PATENT DOCUMENTS

| | | | | | |
|---|---|---|---|---|---|
| 3,650,616 | A | * | 3/1972 | Hudson | 399/22 |
| 3,650,619 | A | * | 3/1972 | Parker | 399/22 |
| 4,073,585 | A | * | 2/1978 | Kobayashi et al. | 399/22 |
| 4,239,372 | A | * | 12/1980 | Iwai | 399/22 |
| 4,512,649 | A | * | 4/1985 | Derimiggio | 399/22 |
| 5,334,817 | A | | 8/1994 | Nakamori et al. | 219/492 |
| 5,365,322 | A | * | 11/1994 | Hameda et al. | 399/21 |
| 5,404,200 | A | * | 4/1995 | Martin et al. | 399/68 |
| 5,406,354 | A | * | 4/1995 | Taki et al. | 399/22 |
| 5,455,659 | A | | 10/1995 | Ishizu et al. | |
| 5,612,776 | A | | 3/1997 | Machino et al. | 399/43 |
| 5,848,319 | A | * | 12/1998 | Morigami et al. | 399/22 |
| 6,438,348 | B2 | | 8/2002 | Kobaru et al. | 399/333 |
| 6,496,661 | B2 | | 12/2002 | Ando et al. | 399/22 |

FOREIGN PATENT DOCUMENTS

| | | | |
|---|---|---|---|
| JP | 11-038817 | * | 2/1999 |
| JP | 2000-255835 | * | 9/2000 |

* cited by examiner

*Primary Examiner*—Sandra Brase
(74) *Attorney, Agent, or Firm*—Fitzpatrick, Cella, Harper & Scinto

(57) ABSTRACT

An image forming apparatus is provided which is capable of positively preventing a recording sheet from being wound around a conveying means that conveys the recording sheet. A high voltage power supply section applies voltage to feeding brushes disposed in contact with the surface of a pressurizing roller having an electrically conductive surface. A winding sensor is disposed in contact with the surface of the pressurizing roller and is located in a sheet passing area of the pressurizing roller. A CPU sets a threshold voltage to a value corresponding to the temperature of the pressurizing roller detected by a temperature sensor, and detects whether the recording sheet is wound around the pressurizing roller, based upon the set threshold voltage and voltage of the pressurizing roller in the sheet passing area detected by the winding sensor.

18 Claims, 9 Drawing Sheets

IMAGE FORMING APPARATUS AND IMAGE FORMING METHOD

BACKGROUND OF THE INVENTION

1. Field of the Invention

The present invention relates to an image forming apparatus and an image forming method, and more particularly to an image forming apparatus and an image forming method which are suitable for detecting a phenomon that a recording sheet adheres to a roller member such as a pressurizing roller and a fixing roller forming a thermal fixing device or to a fixing film, to be wound around the latter.

2. Description of the Related Art

There is widely used an image forming apparatus which transfers a toner image formed on a photosensitive drum onto a recording sheet, and thermally fixes the toner image on the recording sheet by a thermal fixing device having roller members such as a fixing roller and a pressurizing roller to form an image on the recording sheet. In the image forming apparatus using the thermal fixing device of this type, however, if winding of a recording sheet to a roller member such as the fixing roller and the pressurizing roller cannot be detected and the image forming apparatus is operated with tip of the recording sheet wound around any of the roller members, the recording sheet is fully wound around the roller member, which makes it difficult to carry out a jam removing operation.

Therefore, an image forming apparatus and an image forming method are demanded, which positively prevent a recording sheet from being wound around a roller member.

SUMMARY OF THE INVENTION

It is an object of the present invention to provide an image forming apparatus and an image forming method which are capable of positively preventing a recording sheet from being wound around a conveying means that conveys the recording sheet.

To attain the above object, in a first aspect of the present invention, there is provided an image forming apparatus that forms an image on a recording sheet, comprising conveying means for conveying the recording sheet while rotating, the conveying means having a recording sheet passing area, voltage applying means for applying voltage to the conveying means, voltage detecting means for detecting voltage related to the conveying means in the recording passing area, temperature detecting means for detecting a temperature of the conveying means, threshold voltage setting means for setting a threshold voltage corresponding to the temperature detected by the temperature detecting means, and recording sheet winding detecting means for detecting whether the recording sheet is wound around the conveying means, based upon the threshold voltage set by the threshold voltage setting means and the voltage detected by the voltage detecting means.

Preferably, the recording sheet winding detecting means determines that the recording sheet is wound around the conveying means, when the voltage detected by the voltage detecting means is not higher than the threshold voltage threshold voltage set by the threshold voltage setting means.

More preferably, the threshold voltage setting means sets the threshold voltage to a value variable with the temperature detected by the temperature detecting means.

For example, the threshold voltage setting means sets the threshold voltage to a first threshold value when the temperature detected by the voltage detecting means is not lower than a predetermined value at which the threshold voltage is to be switched, and sets the threshold voltage to a second threshold value when the temperature detected by the voltage detecting means is lower than the predetermined value.

The second threshold value is higher than the first threshold value.

Preferably, the image forming apparatus comprises control means for controlling the conveying means, and the control means controls the conveying means such that the recording sheet is inhibited from being conveyed when the recording sheet winding detecting means detects that the recording sheet is wound around the conveying means.

In a preferred embodiment, the conveying means has a pair of rollers that convey the recording sheet interposed therebetween, and wherein the recording sheet winding detecting means detects whether the recording sheet is wound around at least one of the rollers.

Preferably, the pair of rollers comprise a pressurizing roller that applies pressure to the recording sheet, and a fixing roller that carries out a thermally fixing operation on the recording sheet, the voltage applying means applying voltage to the pressurizing roller, the temperature detecting means detecting a surface temperature of the pressurizing roller, and the recording sheet winding detecting means detecting whether the recording sheet is wound around the pressurizing roller.

Preferably, the recording sheet winding detecting means is responsive to turning-on of power supply of the image forming apparatus, for detecting whether the recording sheet is wound around the conveying means.

To attain the above object, in a second aspect of the present invention, there is provided an image forming method of forming an image on a recording sheet, comprising a threshold voltage setting step of detecting a temperature of conveying means for conveying the recording sheet while rotating, and setting a threshold voltage corresponding to the detected temperature, a voltage detecting step of detecting voltage related to the conveying means, and a recording sheet winding detecting step of detecting whether the recording sheet is wound around the conveying means, based upon the threshold voltage set in the threshold voltage setting step and the voltage detected in the voltage detecting step.

Preferably, in the recording sheet winding detecting step it is determined that the recording sheet is wound around the conveying means, when the voltage detected in the voltage detecting step is not higher than the threshold voltage threshold voltage set in the threshold voltage setting step.

More preferably, in the threshold voltage setting step the threshold voltage is set to a value variable with the detected temperature of the conveying means.

For example, in the threshold voltage setting step the threshold voltage is set to a first threshold value when the the detected temperature of the conveying means is not lower than a predetermined value at which the threshold voltage is to be switched, and the threshold voltage is set to a second threshold value when the the detected temperature of the conveying means is lower than the predetermined value.

The second threshold value is higher than the first threshold value.

Preferably, the image forming method comprises a control step of controlling the conveying means such that the recording sheet is inhibited from being conveyed when in the recording sheet winding detecting step it is detected that the recording sheet is wound around the conveying means.

Also preferably, the image forming method comprises a control step of controlling the conveying means such that the recording sheet is allowed to be conveyed when in the recording sheet winding detecting step it is not detected that the recording sheet is wound around the conveying means.

In a preferred embodiment, the conveying means has a pair of rollers that convey the recording sheet interposed therebetween, the pair of rollers comprising a pressurizing roller that applies pressure to the recording sheet, and a fixing roller that carries out a thermally fixing operation on the recording sheet, and wherein the threshold voltage setting step comprises detecting a temperature of the pressurizing roller, and setting the threshold voltage corresponding to the detected temperature, the voltage detecting step comprises detecting voltage applied to the pressurizing roller, and the recording sheet winding detecting step comprises detecting whether the recording sheet is wound around the pressurizing roller.

Preferably, the recording sheet winding detecting step is executed when power supply of an image forming apparatus that executes the image forming method.

The above and other objects, features and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
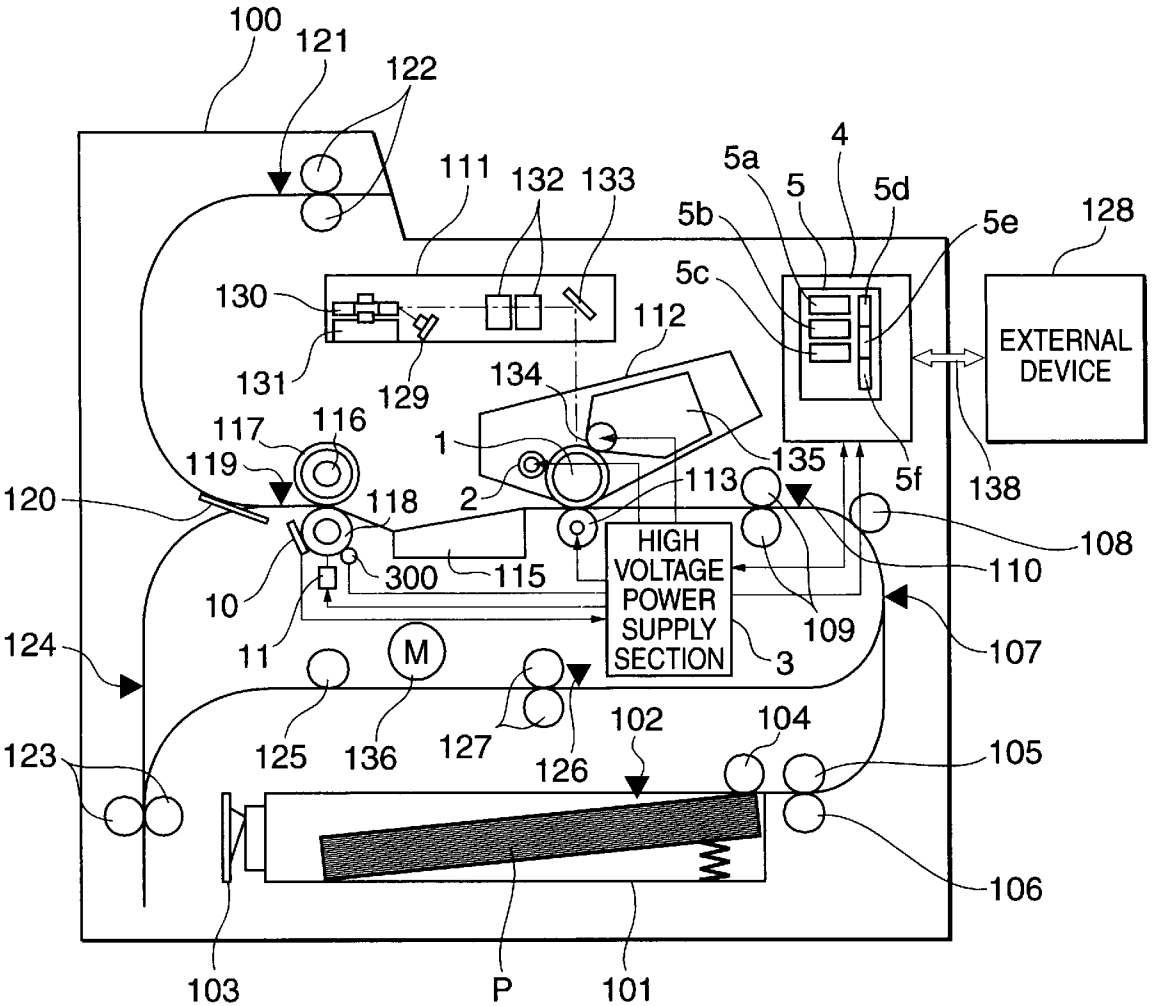
FIG. 1 is a diagram showing the internal construction of a laser beam printer as an image forming apparatus according to a first embodiment of the present invention.
Figure 2:
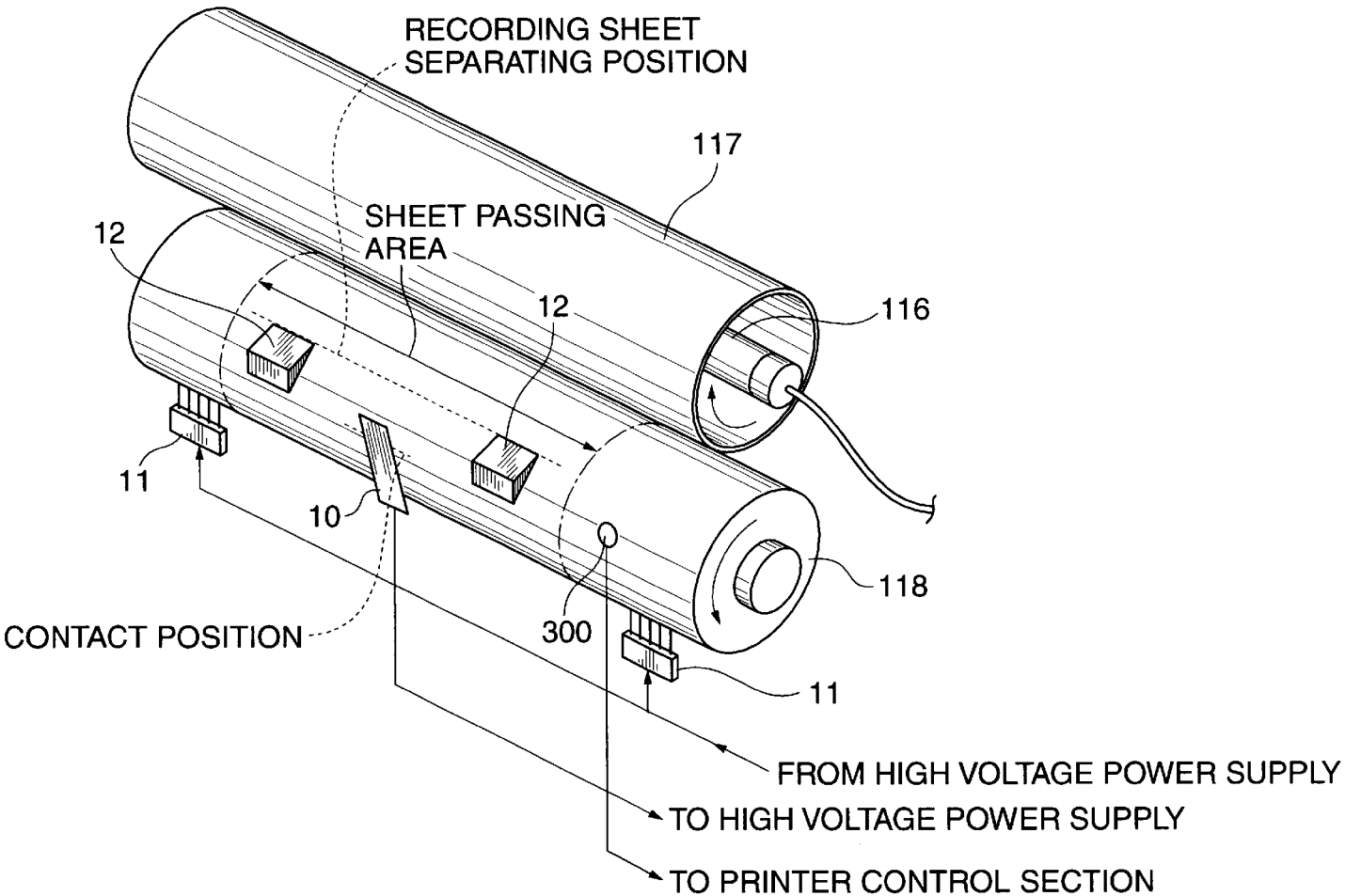
FIG. 2 is a perspective view showing the arrangement of a winding sensor and its related parts with respect to a pressurizing roller in the laser beam printer in FIG. 1.
Figure 3:
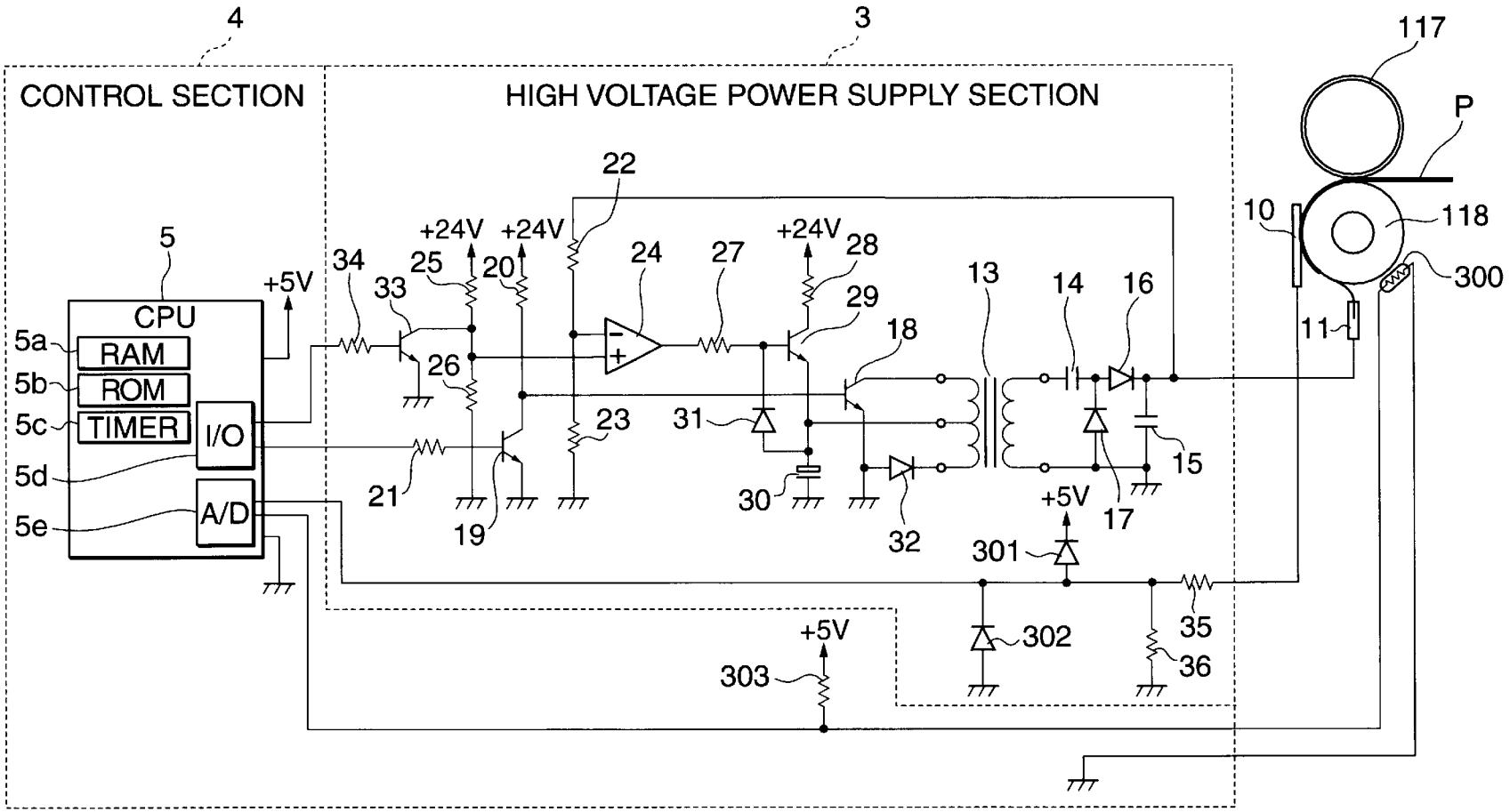
FIG. 3 is a circuit diagram showing the configuration of a recording sheet winding detecting circuit in the laser beam printer in FIG. 1.
Figure 4:
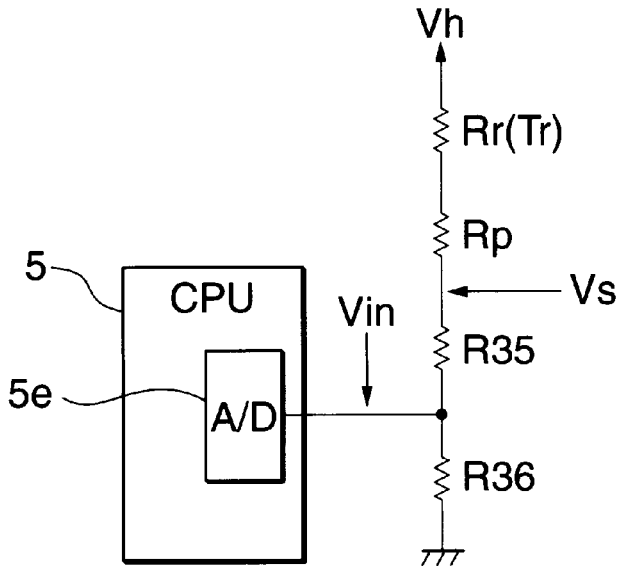
FIG. 4 is a circuit diagram showing the configuration of an equivalent circuit of part of the winding detecting circuit for the laser beam printer in FIG. 1.
Figure 5:
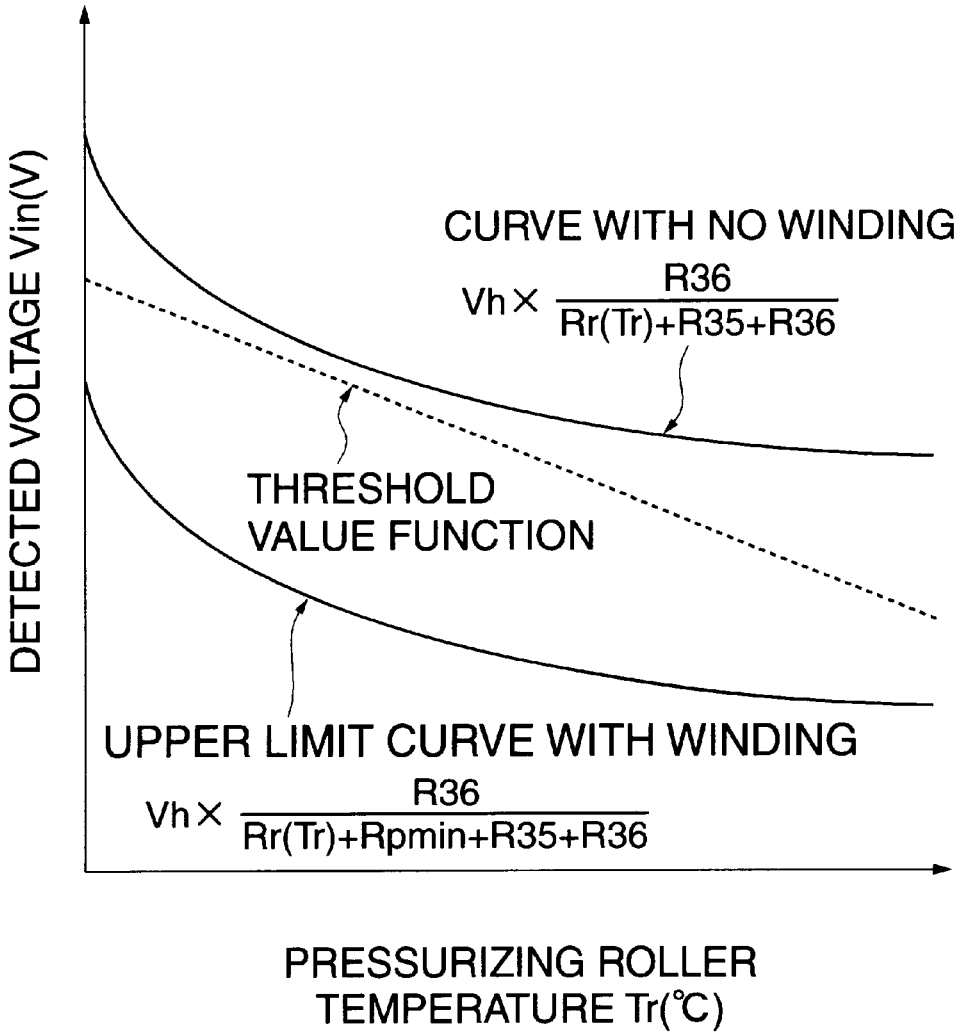
FIG. 5 is a graph showing the relationship between the temperature of the pressurizing roller and voltage detected by the winding sensor.
Figure 6:
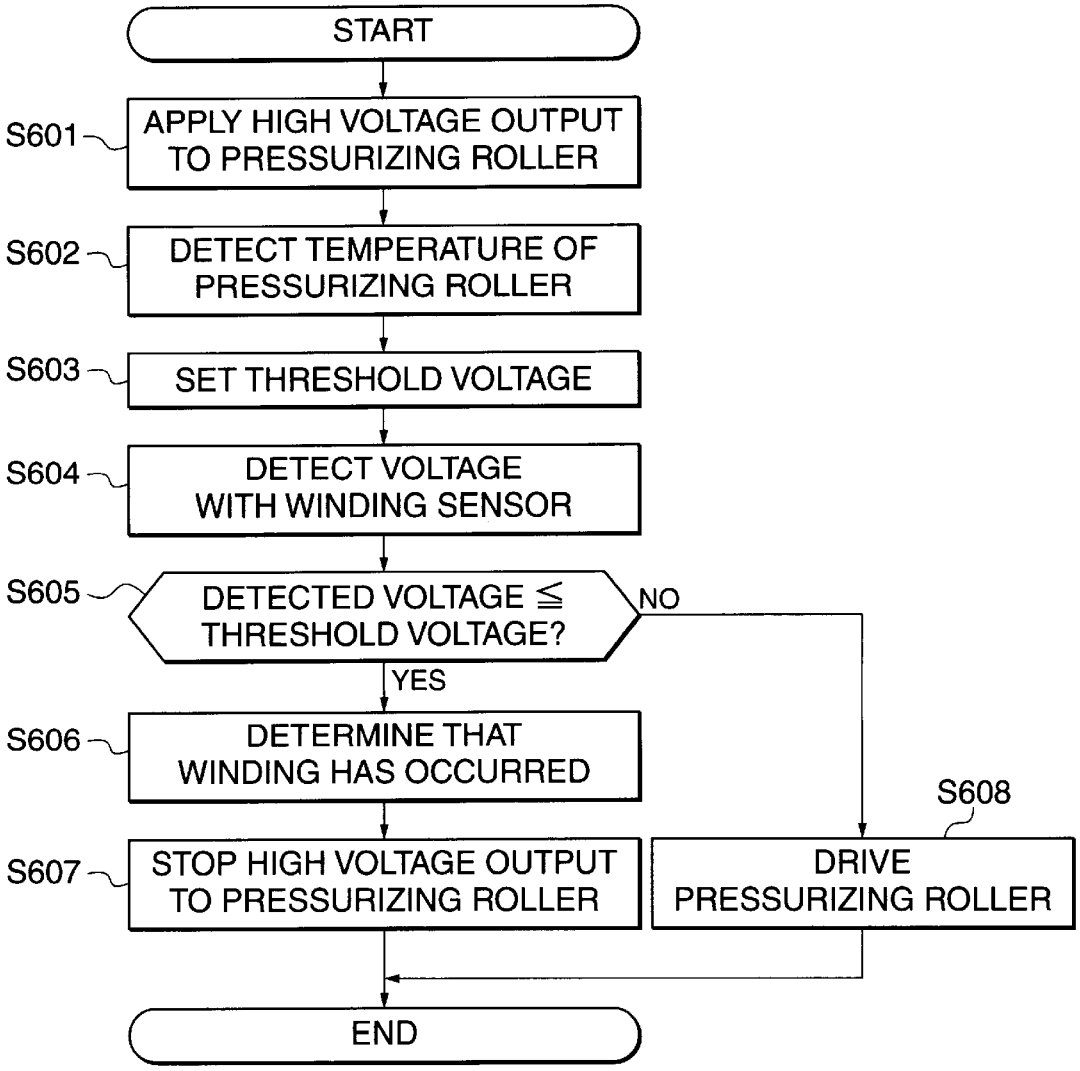
FIG. 6 is a flow chart showing a recording sheet winding detecting process.

FIG. 1 is a diagram showing the internal construction of a laser beam printer as an image forming apparatus according to a first embodiment of the present invention, FIG. 2 is a perspective view showing the arrangement of a winding sensor and its related parts with respect to a pressurizing roller in the laser beam printer in FIG. 1, FIG. 3 is a circuit diagram showing the configuration of a recording sheet winding detecting circuit in the laser beam printer in FIG. 1, FIG. 4 is a circuit diagram showing the configuration of an equivalent circuit of part of the winding detecting circuit for the laser beam printer in FIG. 1, FIG. 5 is a graph showing the relationship between the temperature of the pressurizing roller and voltage detected by the winding sensor, and FIG. 6 is a flow chart showing a recording sheet winding detecting process.

As shown in FIG. 1, the laser beam printer 100 is comprised of a high voltage power supply section 3, a printer control section 4, a winding sensor 10, feeding (conductive) brushes 11, a deck 101, a deck sheet presence sensor 102, a sheet size sensor 103, a pickup roller 104, a deck sheet feeding roller 105, a retard roller 106, a sheet feed sensor 107, a sheet feeding and conveying roller 108, a pair of resist rollers 109, a pre-resist sensor 110, a laser scanner section 111, a process cartridge 112, a roller member 113, a conveying guide 115, a halogen heater 116, a fixing roller 117, a pressurizing roller 118, a fixed sheet discharge sensor 119, a duplex flapper 120, a sheet discharge sensor 121, a pair of sheet discharge rollers 122, a pair of inversion rollers 123, an inversion sensor 124, a D-cut roller 125, a duplex sensor 126, a pair of duplex conveying rollers 127, a main motor 136, an interface 138, and a thermistor 300. In FIG. 1, reference numeral 128 denotes an external device or apparatus.

In further detail, the deck 101 stores a recording sheet P, the deck sheet presence sensor 102 detects whether or not the recording sheet P is stored in the deck 101, the sheet size sensor 103 detects the size of the recording sheet P stored in the deck 101, the pickup roller 104 feeds the recording sheet P from the deck 101, the deck sheet feeding roller 105 conveys the recording sheet P fed by the pickup roller 104, and the retard roller 106 which is paired with the deck sheet feeding roller 105 is intended to prevent simultaneous feeding of two or more recording sheets P.

Further, the deck 101, the sheet discharge sensor 107 that detects the conveyance condition of the recording sheet P fed from a duplex inverting section that will be described later, the sheet feeding and conveying roller 108 that conveys the recording sheet P further downstream, the pair of resist rollers 109 that convey the recording sheet in synchronism with each other, and the pre-resist sensor 110 that detects the conveyance condition of the recording sheet P conveyed to the pair of resist rollers 109 are arranged downstream of the deck sheet feeding roller 105.

Further, the process cartridge 112 that forms a toner image on a photosensitive drum 1 according to laser light from the laser scanner section 111 that will be described later, and the roller member 113 that transfers the toner image formed on the photosensitive drum 1 onto the recording sheet P (hereinafter referred to as "transfer roller") are arranged downstream of the pair of resist rollers 109.

Further, arranged downstream of the transfer roller 113 are the conveyance guide 115 that guides the recording sheet P during conveyance thereof; the pair of rollers comprised of the fixing roller 117 that includes the halogen heater 116 for heating so as to thermally fix a toner image transferred onto the recording sheet P, and the pressurizing roller 118 that has an electrically conductive surface to pressurize the recording sheet P against the fixing roller 117; the feeding brushes 11 that apply a high voltage the surface of the pressurizing roller 118; the winding sensor 10 as an electrically conductive member that detects winding of the recording sheet P around the pressurizing roller 118; the thermistor 300 as temperature detecting means for detecting the surface temperature of the pressuring roller 118, the fixed sheet discharge sensor 119 that detects the conveyance condition of the recording sheet P conveyed from a fixing section; and the duplex flapper 120 that switches the destination of the recording sheet P conveyed from the fixing section between a sheet discharge section and a duplex inverting section. Further, downstream of the duplex flapper 120, the sheet discharge sensor 121 that detects the conveyance condition of the recording sheet in a sheet discharge section, and the pair of sheet discharge rollers 122 that discharge the recording sheet are arranged in the sheet discharge section. The thermistor 300 may be provided exclusively for detecting winding of a recording sheet around the pressurizing roller 118. Alternatively, as the thermistor 300 may be used a thermistor that is used for controlling the temperature of the pressurizing roller 118 in an arrangement that a halogen heater is provided within the pressurizing roller 118 to fix a toner image onto the recording sheet by heat from both the fixing roller and the pressurizing roller. In this alternative case, the thermistor 300 may perform two functions, i.e. temperature control of the pressurizing roller and temperature measurement relating to detection of winding of the recording sheet, whereby a recording winding detecting function may be added without increasing the cost.

On the other hand, in the duplex inverting section that turns the recording sheet upside down after simplex printing in order to print images on both sides of the recording sheet P and feeds the recording sheet P again to an image forming section, there are provided the pair of inversion rollers 123 that switch the path of the recording sheet P backward by reverse rotation, the inversion detecting sensor 124 that detects the conveyance condition of the recording sheet P conveyed to the inversion rollers 123, the D-cut roller 125 that conveys the recording sheet P from a transverse-direction registration section (not illustrated) that aligns the recording sheet P in the transverse direction, the duplex sensor 126 that detects the conveyance condition of the recording sheet P conveyed in the duplex inverting section, and the pair of duplex conveying rollers 127 that convey the recording sheet P from the duplex inverting section to the sheet feeding section.

Further, the scanner section 111 is comprised of a laser unit 129 that emits a laser light modulated according to an image signal transmitted from the external device 128 to the laser beam printer 100, a polygon mirror 130 that scans an image on the photosensitive drum 1 with the laser light emitted from the laser unit 129, a scanner motor 131 that rotates the polygon mirror 130, an image formation lens group 132 that guides the laser light reflected on the polygon mirror 130, and a reflex mirror 133 that reflects the laser light guided by the image formation lens group 132 toward the photosensitive drum 1.

Further, the process cartridge 112 is comprised of the photosensitive drum 1 on which a toner image is to be formed, an electrifying roller 2 that electrifies the photosensitive drum 1, a developing blade 134 that is used for development, a toner container 135 that contains toner, and others, which are required for a known electrophotographing process. The process cartridge 112 is detachable from the frame of the laser printer 100.

The high voltage power supply section 3 is comprised of the electrifying roller 2, the developing blade 134, and a high voltage circuit that feeds a desired voltage to the transfer roller 113, in addition to a pressurizing roller high voltage circuit that will be described later. The main motor 136 supplies power to various sections of the image forming apparatus 100, such as the pressurizing roller 118. Incidentally, although a drive source for driving the pressurizing roller 118 may be either the main motor that supplies power to various sections of the laser beam printer 100 or a motor that is provided for exclusive use in driving the pressurizing roller 118, the following description of the present embodiment assumes that the main motor 136 drives the pressurizing roller 118.

The printer control section 4 is used to control various sections of the laser beam printer 100. The printer control section 4 is comprised of a CPU 5 that is formed by an MPU (microcomputer) including a RAM 5*a*, ROM 5*b*, timer 5*c*, digital input/output ports (hereinafter referred to as "the I/O port") 5*d*, analog-to-digital conversion input ports 5*e* (hereinafter referred to as "the A/D input port), and digital-to-analog conversion output ports 5*f* (hereinafter referred to as "the D/A output port"), a variety of input/output control circuits that are not illustrated, and others. The printer control circuit 4 is connected to the external device 128, which may be a personal computer, via the interface 138.

The CPU 5 of the printer control section 4 controls varrious sections of the image forming apparatus 100, and carries out a process for detecting winding of a recording sheet around a roller member such as the pressurizing roller 118 according to a program stored in the ROM 5*b*, as described later. The RAM 5*a* is a memory that serves as a working area for the CPU 5 and a temporary storage area. The ROM 5*b* is a memory that stores programs to be executed by the CPU 5. The timer 5*c* measures elapsed time. The I/O port 5*d* inputs and outputs digital signals. The A/D input port 5*e* converts input analog signals to digital signals. The D/A output port 5*f* converts digital signals to analog signals and outputs the same.

FIG. 2 is a perspective view showing the arrangement of the winding sensor 10 and its related parts with respect to the pressuring roller 118 of the laser beam printer in FIG. 1. The fixing roller 117 and the pressurizing roller 118 are opposed to each other such that the respective outer peripheral surfaces thereof are held in partial contact with each other in the axial direction, and they are driven to rotate in respective directions indicated by arrows in FIG. 2. The fixing roller 117 is shaped like a cylinder, and the halogen heater 116 is disposed in the axial direction in the fixing roller 117. Separation pawls 12 serving as a separation mechanism for separating the recording sheet P from the pressurizing roller 118 are disposed in proximity to the pressurizing roller 118.

The winding sensor 10 is disposed in contact with the surface of the pressurizing roller 118 at a location within a sheet passing area of the pressurizing roller 118 and between the separation pawls 12 and a roller nip portion (i.e. an area between the pressurizing roller 118 and the fixing roller 117) which is located downstream of the separation pawls 12 in the rotating direction of the pressurizing roller 118. Here, by setting the contact pressure of the winding sensor 10 against the pressurizing roller 118 to a predetermined value (e.g. 100 gf) or less, a difference in the output voltage of the winding sensor 10 can be made large between a case where a recording sheet is caught between the winding sensor 10 and the pressurizing roller 118 and a case where no recording sheet is caught between the winding sensor 10 and the pressurizing roller 118, so that an error in detection can be prevented.

The thermistor 300 that detects the surface temperature of the pressurizing roller 118 is disposed in contact with a non-sheet passing area (an area outside the sheet passing area) of the pressurizing roller 118. The feeding brushes 11 for feeding a high voltage to the surface of the pressurizing roller 118 are disposed respectively at both ends of the pressurizing roller 118 in the longitudinal direction. An output from the winding sensor 10 is inputted to the high voltage power supply section 3, an output from the thermistor 300 is inputted to the printer control section 4, and the high voltage power supply section 3 supplies a high voltage to the feeding brushes 11. In FIG. 2, a range indicated by a double-headed arrow is the sheet passing area, a broken line along the separation pawls 12 indicates a recording sheet separating position, and a broken line in proximity to the winding sensor 10 indicates a contact position.

FIG. 3 is a circuit diagram showing the configuration of a recording sheet winding detecting circuit of the laser beam printer 100 in FIG. 1. In FIG. 3, reference numeral 13 denotes an inverter transformer. An output voltage generated across a secondary winding of the inverter transformer 13 is rectified (to about 300 volts, for example) by a voltage doubler rectifier circuit comprised of high voltage capacitors 14, 15 and high voltage diodes 16, 17, and is then applied to the feeding brushes 11.

It should be noted that the application of the high voltage to the pressurizing roller 118 aims at preventing so-called electrostatic offsetting. The electrostatic offsetting means a phenomenon that an electric field that draws the toner off from the recording sheet is generated due to friction between the recording sheet and the roller member, for example, to cause the toner to be transferred to the roller member when the recording sheet bearing a charged toner image passes the roller member. In this case, the toner transferred onto the roller member adheres to a recording sheet that is subsequently conveyed, and gives an adversary effect on the image. To prevent the electrostatic offsetting, the voltage is applied to the pressurizing roller 118 to generate an electric field that draws the toner to the recording sheet. In the present embodiment, positive voltage reverse in polarity to toner (negative polarity) is applied to the pressurizing roller 118 disposed in contact with a reverse side of the recording sheet bearing the toner image to generate an electric field that draws the toner to the recording sheet.

Further, at the primary side of the inverter transformer 13, a clock signal outputted from the I/O port 5*d* of the CPU 5 is turned on/off via a base resistor 21 connected to a base of a small signal transistor 19, the small signal transistor 19, a pull-up resistor 20 connected to a collector of the small signal transistor 19, and a transistor 18. In order to control the output voltage of the inverter transformer 13 to a predetermined voltage (e.g. 300 volts), a voltage obtained by dividing the output voltage by resistors 22, 23 is inputted to an inverting input terminal of an operational amplifier 24, and a reference voltage obtained by dividing a power supply voltage+24V by resistors 25, 26 is inputted to a non-inverting input terminal of the operational amplifier 24, and an output from the operational amplifier 24 is supplied to the inverter transformer 13 via a transformer drive circuit comprised of resistors 27, 28, a transistor 29, and an aluminium electrolytic capacitor 30 whereby the input voltage of the inverter transformer 13 is regulated.

The diode 31 is a protective diode that protects the transistor 29, and the diode 32 is used to allow flyback current to flow to the inverter transformer 13. Further, a signal from the I/O port 5*d* of the CPU 5 causes a transistor 33 to be turned on via a resistor 34 to cause the non-inverting input terminal of the operational amplifier 24 to be shorted to ground via the transistor 33 so that the reference voltage can be 0 volts and hence a high voltage output can be turned off.

On the other hand, the output voltage from the winding sensor 10 is divided by resistors 35 and 36, and the divided voltage is input to an A/D input port 5*e*. Reference numerals 301 and 302 designate diodes for protection of the A/D input port 5*e* of the CPU 5. A thermistor 300 whose resistance value varies with its temperature and a pull-up resistance 303 cooperate to divide the power supply voltage of 5 volts, and the divided voltage is input to the A/D input port 5*e* so that the surface temperature of the pressurizing roller 118 can be detected.

Next, a description will be given of a manner of detecting winding of a recording sheet around the pressurizing roller 118 of the laser beam printer 100 according to the first embodiment constructed as above, with reference to FIGS. 1 to 6.

FIG. 4 is an equivalent circuit diagram in which are shown a voltage (Vh) applied to the feeding brushes 11, the resistance value (Rr(Tr)) of the pressurizing roller 118 located between the feeding brushes 11 and the winding sensor 10, the resistance value (Rp) of the recording sheet between the pressurizing roller 118 and the winding sensor 10, the detected voltage (Vs) from the winding sensor 10, the resistance value (R35) of the resistor 35, the resistance value (R36) of the resistor 36, and input voltage (Vin) to the A/D input port 5*e* of the CPU 5.

First, when no recording sheet P is wound around the pressurizing roller 118, the resistance value Rp of the recording sheet is 0, and consequently, the input voltage Vin is expressed as follows:

$$Vin=Vh\times R36\div(Rr(Tr)+R35+R36)$$

Further, in the present embodiment, the resistance value Rr(Tr) of the pressurizing roller 118 varies with the temperature Tr of the pressurizing roller 118 such that the higher the temperature, the greater the resistance value Rr(Tr). Thus, the resistance value Rr(Tr) varies as indicated by a "curve when winding does not occur" in the Tr-Vin characteristic of FIG. 5.

On the other hand, when the recording sheet P is wound around the pressurizing roller 118, the input voltage Vin is expressed as follows:

$$Vin=Vh\times R36\div(Rr(Tr)+Rp+R35+R36)$$

Further, if the resistance value of the recording sheet P assumes a lower limit Rpmin, the input voltage Vin assumes an "upper limit curve when winding occurs" appearing in the Tr-Vin characteristic of FIG. 5. When the resistance value of the recording sheet P is larger than the lower limit Rpmin, the input voltage Vin is lower than the "upper limit curve when winding occurs".

A threshold value function which is variable with the temperature Tr of the pressurizing roller 118 is provided beforehand between the "curve when winding does not occur" and a "curve when winding occurs". The CPU 5 of the printer control section 4 determines that the recording sheet P is wound around the pressurizing roller 118 when the detected voltage from the winding sensor 10 is not more than a threshold voltage value calculated from the threshold value function, and determines that the recording sheet is not wound around the pressurizing roller 118 when the detected volate from the winding sensor 10 exceeds the threshold voltage value calculated from the threshold value function. Upon determining that the recording sheet P is wound around the pressurizing roller 118, the CPU 5 of the printer control section 4 carries out control such as stopping the fixing roller 117 and the pressurizing roller 118.

A detailed description will now be given of the operation of the first embodiment of the present invention constructed as above with reference to the flow chart of FIG. 6.

When the image forming apparatus starts the image forming process upon power being applied, a door of the apparatus being closed once it has been opened, or the like, in a step S601 the high voltage power supply section 3 applies power to the pressurizing roller 118 via the feeding brushes 11.

In a step S602, the thermistor 300 detects the surface temperature Tr of the pressurizing roller 118, and in a step S603 the CPU 5 calculates the threshold voltage by substituting the temperature value Tr into the threshold value function. Then, in a step S604 the voltage of the pressurizing roller 118 detected by the winding sensor 10 is fetched.

In a step S605, the threshold voltage calculated by the CPU 5 in the step S603 and the detected voltage from the winding sensor 10 fetched in the step S604 are compared with each other, and if the detected voltage is equal to or lower than the threshold voltage, the answer becomes YES and it is determined in a step S606 that the recording sheet is wound around the pressurizing roller 118, followed by the process proceeding to a step S607 to stop power from being applied to the pressurizing roller 118 to interrupt the image forming operation. If the detected voltage is higher than the threshold voltage, it is determined that the recording sheet is not wound around the pressurizing roller 118, and then the process proceeds to a step S608 where the pressurizing roller is driven to carry out a normal image forming operation.

Although in the present embodiment the threshold value function is indicated as a primary curve, if the threshold value function cannot be set to such a primary curve depending upon the situations, the threshold value function may be set to a higher order curve, or a plurality of threshold value functions may be provided for respective temperature Tr ranges of the pressurizing roller 118.

As described above, the laser beam printer according to the present embodiment is comprised of the pressurizing roller 118 having an electrically conductive surface and arranged in opposed relation to the thermally fixing roller 117, the feeding brushes 11 disposed in contact with the surface of the pressurizing roller 118, the high voltage power supply section 3 that applies voltage to the feeding brushes 11, the winding sensor 10 disposed in contact with the surface of the pressure sensor and located in the recording sheet passing area of the pressurizing roller 118, the thermistor 300 that detects the surface temperature of the pressuring roller 118, and the CPU 5 that compares the detected voltage from the winding sensor 10 and the threshold voltage value corresponding to the output from the thermistor 300 and determines, based upon the results of the comparison, whether or not the recording sheet is wound around the pressurizing roller 118. As a result, the winding of the recording sheet around the pressurizing roller 118 can be detected without being affected by the temperature characteristics of the resistance value of the pressurizing roller 118 to thereby reliably prevent the phenomenon that the recording sheet is wound around the pressurizing roller 118.

Next, a description will be given of a second embodiment of the present invention with reference to the drawings.

Figure 7:
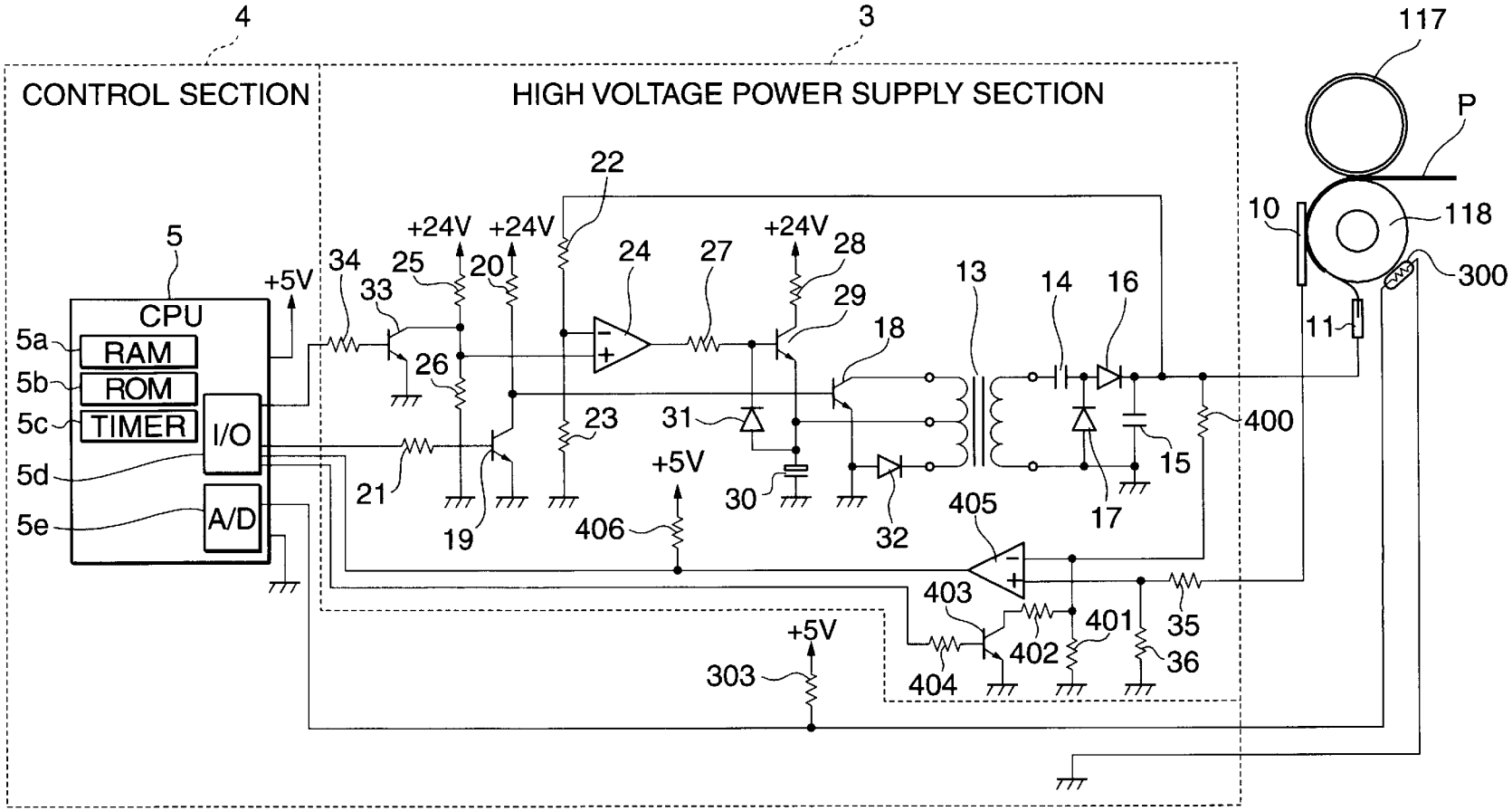
FIG. 7 is a circuit diagram showing the configuration of a winding detecting circuit of a laser beam printer as an image forming apparatus according to a second embodiment of the present invention.
Figure 8:
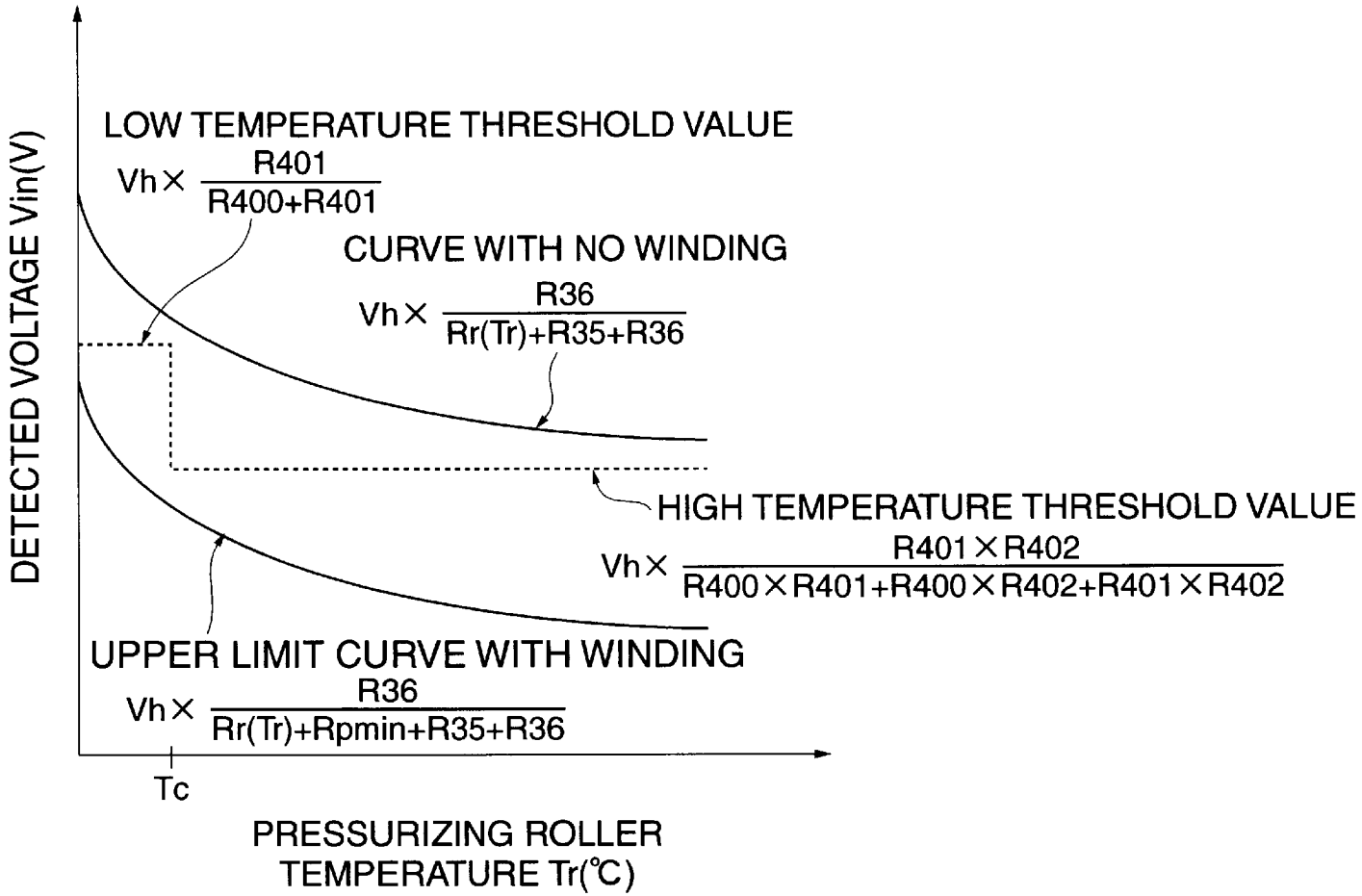
FIG. 8 is a graph showing the relationship between the temperature of the pressurizing roller and voltage detected by the winding sensor in the laser beam printer in FIG. 7.
Figure 9:
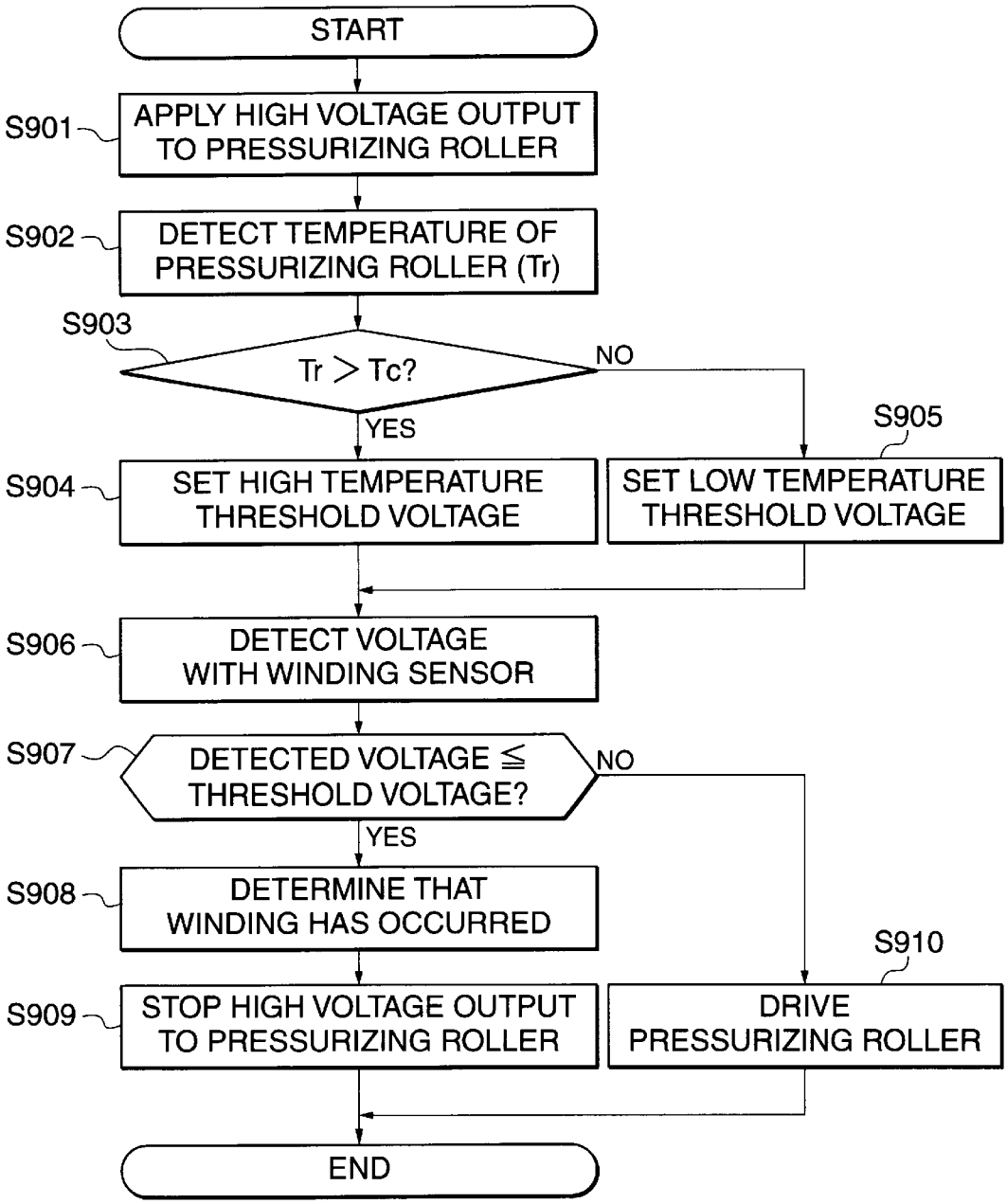
FIG. 9 is a flow chart showing a recording sheet winding detecting process according to the second embodiment.

FIG. 7 is a circuit diagram showing the configuration of a winding detecting circuit of a laser beam printer as an image forming apparatus according to the second embodiment. FIG. 8 is a graph showing the relationship between the temperature of the pressurizing roller and voltage detected by the winding sensor in the laser beam printer in FIG. 7. FIG. 9 is a flow chart showing a recording sheet winding detecting process according to the second embodiment.

In the second embodiment, the construction of the laser beam printer 100 and the arrangement of the winding sensor 10 and its related parts with respect to the pressurizing roller 118 in the laser beam printer 100 are identical with those shown in FIGS. 1 and 2 of the first embodiment described above, and description thereof is therefore omitted.

The construction of the laser beam printer according to the present embodiment is different from that of the first embodiment shown in FIG. 3 in that a voltage value obtained by dividing the detected voltage from the winding sensor 10 by the resistors 35, 36 and a threshold voltage obtained by dividing the voltage applied to the feeding brushes 11 by resistors 400, 401 and 402 are compared with each other by a comparator 405 of an open collector output type, and based upon results of the comparison, power supply voltage from a +5V power source is inputted to the I/O port 5*d* of the CPU 5 via a pull-up resistor 406 connected to the +5V power source. Except for this, the construction in FIG. 7 is identical with that in FIG. 3, and description thereof is therefore omitted.

Next, a description will be given of a manner of detecting winding of recording sheet around the pressurizing roller 118 of the laser beam printer 100 according to the second embodiment, with reference to FIGS. 1, 2, 7 and 8.

In the present embodiment, as is the case with the first embodiment, the detection of winding of the recording sheet around the pressurizing roller 118 is carried out such that the CPU 5 of the printer control section 4 determines that the recording sheet P is wound around the pressurizing roller 118, when the detected voltage from the winding sensor 10 is equal to or lower than the threshold voltage, that is, the input level to the I/O port 5*d* of the CPU 5 is low, while the CPU 5 determines that the recording sheet P is not wound around the pressurizing roller 118, when the detected voltage from the winding sensor 10 is higher than the threshold voltage, that is, the input level to the I/O port 5*d* is high. Upon determining that the recording sheet P is wound around the pressurizing roller 118, the CPU 5 of the printer control section 4 carries out control such as stopping the fixing roller 117 and the pressurizing roller 118.

Further, according to the present embodiment, compared with the construction of the first embodiment, the number of A/D ports of the CPU 5 can be reduced, and moreover, since the threshold voltage is generated from the voltage applied to the feeding brushes 11, accurate detection of the winding of the recording sheet can be achieved with higher accuracy, irrespective of variations in the voltage applied to the feeding brushes.

Yet further, according to the present embodiment, the threshold voltage can be varied by turning a transistor 403 on or off via a base resistor 404 by a control voltage from the I/O port 5*d* of the CPU 5. Specifically, as shown in the Tr-Vin characteristic of FIG. 8, when the temperature of the pressurizing roller 118 is low (in the present embodiment, Tr<Tc), a low output from the I/O port 5*d* of the CPU 5 is applied to the transistor 403 to turn the same off so that the threshold voltage is set to a low temperature threshold voltage value expressed as follows:

$$Vh \times R401 \div (R400 + R401)$$

When the temperature of the pressurizing roller 118 is high (Tr>Tc), a high output from the I/O port 5*d* of the CPU 5 is applied to the transistor 403 to turn the same on so that the threshold voltage is set to a high temperature threshold voltage value expressed as follows:

$$Vh \times R401 \times R402 \div (R400 \times R401 + R400 \times R402 + R401 \times R402)$$

Here, R400, R401, and R403 represent the resistance values of the resistor 400, 401, and 402, respectively. It should be noted that the low temperature threshold voltage value is set to a higher value than the high temperature threshold voltage value.

The operation of the second embodiment constructed as above will now be described in detail with reference to the flow chart of FIG. 9.

When the image forming apparatus starts the image forming process upon power being applied, a door of the apparatus being closed once it has been opened, or the like, in a step S901 the high voltage power supply section 3 applies power to the pressurizing roller 118 via the feeding brushes 11.

In a step S902, the thermistor 300 detects the surface temperature Tr of the pressurizing roller 118, and in a step S903 the CPU 5 determines whether or not the temperature Tr is higher than the temperature Tc at which the threshold voltage value is to be switched. If Tr>Tc, the process proceeds to a step S904 to set the threshold voltage to the high temperature threshold voltage value, while if Tr≦Tc, the process proceeds to step S905 to set the threshold voltage to the low temperature threshold voltage value.

In a step S906, the voltage of the pressurizing roller 118 detected by the winding sensor 10 is fetched. And then, in a step S907, the threshold voltage set by the CPU 5 in the step S904 or S905 and the detected voltage from the winding sensor 10 fetched in the step S906 are compared with each other, and if the detected voltage is equal to or lower than the threshold voltage, the answer becomes YES and it is determined in a step S908 that the recording sheet is wound around the pressurizing roller 118, followed by the process proceeding to a step S909 to stop power from being applied to the pressurizing roller 118 to interrupt the image forming operation. If the detected voltage is higher than the threshold voltage, it is determined that the recording sheet is not wound around the pressurizing roller 118, and then in a step S910 the pressurizing roller is driven to carry out the normal image forming operation.

Although in the present embodiment, two voltage values are provided for the threshold voltage, if such two two values cannot be applied to the threshold voltage depending upon the situations, a plurality of the threshold value switching circuit comprised of the resistor 402, the transistor 403, and the resistor 404 may be provided between the junction between the resistors 401 and 400 and one or more other I/O ports of the CPU 5 to thereby provide a plurality of threshold values.

As described above, the laser beam printer according to the present embodiment is comprised of the pressurizing roller 118 having an electrically conductive surface and disposed in opposed relation to the thermally fixing roller 117, the feeding brushes 11 disposed in contact with the surface of the pressurizing roller 118, the high voltage power supply section 3 that applies voltage to the feeding brushes 11, the winding sensor 10 disposed in contact with the surface of the pressurizing roller 118 and located in a recording sheet passing area of the pressurizing roller 118, the thermistor 300 that detects the surface temperature of the pressurizing roller 118, and the CPU 5 that switches the threshold voltage according to the output from the thermistor 300, compares the threshold voltage value corresponding to the output from the thermistor 300 and the detected voltage from the winding sensor 10, and determines, based upon the results of the comparison, whether or not the recording sheet is wound around the pressurizing roller 118. As a result, the winding of the recording sheet around the pressurizing roller 118 can be detected without being affected by the temperature characteristics of the resistance value of the pressurizing roller 118 to thereby reliably prevent the phenomenon that the recording sheet is wound around the pressurizing roller 118.

Although the above described first and second embodiments are directed to the detection of winding of the recording sheet around the pressurizing roller 118, the present invention is not limited to this, but may be applied to the detection of winding of the recording sheet around the fixing roller 117. In this case, the winding sensor 10, the thermistor 300 and others are also arranged on the fixing roller 117 side to detect the winding of the recording sheet around the fixing roller 117.

Further, although the above described first and second embodiments are directed to the detection of winding of the recording sheet in the arrangement that the image forming apparatus (laser beam printer) is connected to an external device such as a personal computer via an interface, the present invention is not limited to this, but may be applied to detection of winding of the recording sheet in a system which is comprised of an arbitrary number of image forming apparatuses (lazer beam printers or the like) and an arbitrary number of external devices such as personal computers are connected via a network.

Moreover, although the above described first and second embodiments are directed to the detection of winding of the recording sheet in an image forming apparatus (laser beam printer), the present invention is not limited to this, but the present invention may be applied, for example, to detection of winding of the recording sheet around a roller in an image forming section of a copying machine having an image reading function and an image forming function, and detection of winding of the recording sheet around a roller in an image forming section of a composite machine (multifunction peripheral; MFP) having a plurality of functions including an image reading function, an image forming function, and a facsimile function.

It should be noted that the present invention may either be applied to a system composed of a plurality of apparatuses or to a single apparatus. Moreover, it goes without saying that the objects of the present invention can also be achieved by supplying a system or an apparatus with a storage medium storing program code of a software program that realizes the functions of the embodiments described above, and then causing a computer (or CPU, MPU or the like) of the system or apparatus to read and execute the program code stored on the storage medium.

In this case, the program code itself read from the storage medium realizes the functions of the embodiments described above, and hence the storage medium on which the program code is stored constitutes the present invention. Examples of the storage medium for supplying the program code include a floppy disk, a hard disk, an optical disk, a magnetic-optical disk, a CD-ROM, a CD-R, a magnetic tape, a nonvolatile memory card, and a ROM. Alternatively, the program code may be downloaded from a network.

Moreover, it also goes without saying that the functions of the embodiments described above may be realized not necessarily by causing the computer to read and execute the program code, but alternatively by causing an operating system (OS) running on the computer to perform part or all of the actual processing based on instructions in the program code.

Furthermore, it also goes without saying that the functions of the embodiments described above may be realized by writing the program code read from the storage medium into a memory provided on a function expansion board inserted into the computer or in a function expansion unit connected to the computer, and then causing a CPU or the like provided on the function expansion board or in the function expansion unit to perform part or all of the actual processing based on instructions in the program code.

What is claimed is:

1. An image forming apparatus that forms an image on a recording sheet, comprising:

conveying means for conveying the recording sheet while rotating, said conveying means having a recording sheet passing area;

voltage applying means for applying voltage to said conveying means;

voltage detecting means for detecting voltage related to said conveying means in the recording sheet passing area;

temperature detecting means for detecting a temperature of said conveying means;

threshold voltage setting means for setting a threshold voltage corresponding to the temperature detected by said temperature detecting means; and recording sheet winding detecting means for detecting whether the recording sheet is wound around said conveying means, based upon the threshold voltage set by said threshold voltage setting means and the voltage detected by said voltage detecting means.

2. An image forming apparatus as claimed in claim 1, wherein said recording sheet winding detecting means determines that the recording sheet is wound around said conveying means, when the voltage detected by said voltage detecting means is not higher than the threshold voltage threshold voltage set by said threshold voltage setting means.

3. An image forming apparatus as claimed in claim 2, wherein said threshold voltage setting means sets the threshold voltage to a value variable with the temperature detected by said temperature detecting means.

4. An image forming apparatus as claimed in claim 2, wherein said threshold voltage setting means sets the threshold voltage to a first threshold value when the temperature detected by said voltage detecting means is not lower than a predetermined value at which the threshold voltage is to be switched, and sets the threshold voltage to a second threshold value when the temperature detected by said voltage detecting means is lower than the predetermined value.

5. An image forming apparatus as claimed in claim 4, wherein the second threshold value is higher than the first threshold value.

6. An image forming apparatus as claimed in claim 1, further comprising control means for controlling said conveying means, and wherein said control means controls said conveying means such that the recording sheet is inhibited from being conveyed when said recording sheet winding detecting means detects that the recording sheet is wound around said conveying means.

7. An image forming apparatus as claimed in claim 1, wherein said conveying means has a pair of rollers that convey the recording sheet interposed therebetween, and wherein said recording sheet winding detecting means detects whether the recording sheet is wound around at least one of said rollers.

8. An image forming apparatus as claimed in claim 7, wherein said pair of rollers comprise a pressurizing roller that applies pressure to the recording sheet, and a fixing roller that carries out a thermally fixing operation on the recording sheet, said voltage applying means applying voltage to said pressurizing roller, said temperature detecting means detecting a surface temperature of said pressurizing roller, and said recording sheet winding detecting means detecting whether the recording sheet is wound around said pressurizing roller.

9. An image forming apparatus as claimed in claim 1, wherein said recording sheet winding detecting means is responsive to turning-on of power supply of the image forming apparatus, for detecting whether the recording sheet is wound around said conveying means.

10. An image forming method of forming an image on a recording sheet, comprising:

a threshold voltage setting step of detecting a temperature of conveying means for conveying the recording sheet while rotating, and setting a threshold voltage corresponding to the detected temperature;

a voltage detecting step of detecting voltage related to said conveying means; and a recording sheet winding detecting step of detecting whether the recording sheet is wound around said conveying means, based upon the threshold voltage set in said threshold voltage setting step and the voltage detected in said voltage detecting step.

11. An image forming method as claimed in claim 10, wherein in said recording sheet winding detecting step it is determined that the recording sheet is wound around said conveying means, when the voltage detected in said voltage threshold step is not higher than the threshold voltage threshold voltage set in said threshold voltage setting step.

12. An image forming method as claimed in claim 11, wherein in said threshold voltage setting step the threshold voltage is set to a value variable with the detected temperature of said conveying means.

13. An image forming method as claimed in claim 10, wherein in said threshold voltage setting step the threshold voltage is set to a first threshold value when the detected temperature of said conveying means is not lower than a predetermined value at which the threshold voltage is to be switched, and the threshold voltage is set to a second threshold value when the detected temperature of said conveying means is lower than the predetermined value.

14. An image forming method as claimed in claim 13, wherein the second threshold value is higher than the first threshold value.

15. An image forming method as claimed in claim 10, further comprising a control step of controlling said conveying means such that the recording sheet is inhibited from being conveyed when in said recording sheet winding detecting step it is detected that the recording sheet is wound around said conveying means.

16. An image forming method as claimed in claim 10, further comprising a control step of controlling said conveying means such that the recording sheet is allowed to be conveyed when in said recording sheet winding detecting step it is not detected that the recording sheet is wound around said conveying means.

17. An image forming method as claimed in claim 10, wherein said conveying means has a pair of rollers that convey the recording sheet interposed therebetween, said pair of rollers comprising a pressurizing roller that applies pressure to the recording sheet, and a fixing roller that carries out a thermally fixing operation on the recording sheet, and wherein said threshold voltage setting step comprises detecting a temperature of said pressurizing roller, and setting the threshold voltage corresponding to the detected temperature, said voltage detecting step comprises detecting volltage applied to said pressurizing roller, and said recording sheet winding detecting step comprises detecting whether the recording sheet is wound around said pressurizing roller.

18. An image forming method as claimed in claim 10, wherein said recording sheet winding detecting step is executed when power supply of an image forming apparatus that executes the image forming method.

* * * * *

UNITED STATES PATENT AND TRADEMARK OFFICE

CERTIFICATE OF CORRECTION

PATENT NO. : 6,718,146 B2
DATED : April 6, 2004
INVENTOR(S) : Tomohiro Nakamori

It is certified that error appears in the above-identified patent and that said Letters Patent is hereby corrected as shown below:

Column 1,
Line 60, “threshold voltage” should be deleted.

Column 3,
Line 23, “method.” should read -- method is switched on. --.

Column 5,
Line 1, “voltage” should read -- voltage to --.

Column 8,
Line 62, “volate” should read -- voltage --.

Column 11,
Line 37, “two two” should read -- two --.

Column 12,
Line 18, “(lazer” should read -- (laser --.

Signed and Sealed this

Seventeenth Day of August, 2004

JON W. DUDAS
*Acting Director of the United States Patent and Trademark Office*